US009968827B2

(12) United States Patent
Beno et al.

(10) Patent No.: US 9,968,827 B2
(45) **Date of Patent: *May 15, 2018**

(54) GOLF CLUB GRIP WITH DEVICE HOUSING

(71) Applicant: Cobra Golf Incorporated, Carlsbad, CA (US)

(72) Inventors: Tim A. Beno, San Diego, CA (US); Andrew Curtis, San Diego, CA (US); Michael T. McDonnell, Carlsbad, CA (US); Scott H. Moreira, San Diego, CA (US); Michael S. Yagley, Carlsbad, CA (US)

(73) Assignee: Cobra Golf Incorporated, Carlsbad, CA (US)

( * ) Notice: Subject to any disclaimer, the term of this patent is extended or adjusted under 35 U.S.C. 154(b) by 83 days.

This patent is subject to a terminal disclaimer.

(21) Appl. No.: 15/217,170

(22) Filed: Jul. 22, 2016

(65) Prior Publication Data

US 2016/0346657 A1 Dec. 1, 2016

Related U.S. Application Data

(63) Continuation of application No. 15/088,550, filed on Apr. 1, 2016, now Pat. No. 9,409,071, which is a (Continued)

(51) Int. Cl.
*A63B 53/00* (2015.01)
*A63B 53/14* (2015.01)
(Continued)

(52) U.S. Cl.
CPC ..... *A63B 24/0062* (2013.01); *A63B 53/00* (2013.01); *A63B 53/14* (2013.01);
(Continued)

(58) Field of Classification Search
CPC ..... A63B 53/00; A63B 53/14; A63B 59/0092; A63B 60/08; A63B 60/14; A63B 60/54;
(Continued)

(56) References Cited

U.S. PATENT DOCUMENTS 1,528,190 A 7/1923 Howe
1,709,546 A 4/1929 Stanton
(Continued)

FOREIGN PATENT DOCUMENTS

JP 2003190334 A 7/2003
JP 2005-168998 A 6/2005

OTHER PUBLICATIONS

Machine translation generated on Mar. 9, 2016, of JP 2005168998A (14 pages).

(Continued)

*Primary Examiner* — Raleigh W Chiu
(74) *Attorney, Agent, or Firm* — Brown Rudnick LLP; Mark S. Leonardo

(57) ABSTRACT

The invention relates to golf clubs, more particularly to mechanisms for fastening accessories to clubs. The invention provides a golf club configured to house an electronic device such as an RFID tag within a recess within the grip, thereby protecting the device from the stress, shock, and exposure that arises when a golf club is used.

15 Claims, 10 Drawing Sheets

Related U.S. Application Data continuation of application No. 15/049,832, filed on Feb. 22, 2016, now Pat. No. 9,403,073, which is a continuation of application No. 14/957,126, filed on Dec. 2, 2015, now Pat. No. 9,789,361, which is a continuation of application No. 14/496,460, filed on Sep. 25, 2014, now Pat. No. 9,227,118, which is a continuation of application No. 13/946,543, filed on Jul. 19, 2013, now Pat. No. 8,870,673, which is a continuation of application No. 13/711,097, filed on Dec. 11, 2012, now Pat. No. 8,517,850.

(51) Int. Cl.

| | |
|---|---|
| ***A63B 24/00*** | (2006.01) |
| ***A63B 60/54*** | (2015.01) |
| ***A63B 60/08*** | (2015.01) |
| ***A63B 60/14*** | (2015.01) |
| ***A63B 60/46*** | (2015.01) |
| ***A63B 60/42*** | (2015.01) |
| ***A63B 69/36*** | (2006.01) |
| *A63B 60/00* | (2015.01) |

(52) U.S. Cl.

CPC ..... *A63B 60/08* (2015.10); *A63B 60/14* (2015.10); *A63B 60/42* (2015.10); *A63B 60/46* (2015.10); *A63B 60/54* (2015.10); *A63B 69/36* (2013.01); *A63B 2060/002* (2015.10); *A63B 2208/0204* (2013.01); *A63B 2209/10* (2013.01); *A63B 2220/17* (2013.01); *A63B 2220/40* (2013.01); *A63B 2220/833* (2013.01); *A63B 2225/54* (2013.01)

(58) Field of Classification Search

CPC ..... A63B 2060/002; A63B 2209/10; A63B 2220/833; A63B 2225/54; A63B 24/0062; A63B 60/42; A63B 60/46; A63B 69/36; A63B 2220/17; A63B 2220/40; A63B 2208/0204

See application file for complete search history.

(56) References Cited

U.S. PATENT DOCUMENTS

| | | | |
|---|---|---|---|
| 2,004,968 | A | 6/1935 | Young |
| 2,014,829 | A | 9/1935 | Young |
| 2,178,872 | A | 3/1939 | Engstrom |
| 2,301,369 | A | 11/1942 | Carvill |
| 2,593,368 | A | 4/1952 | Verderber |
| 3,589,731 | A | 6/1971 | Chancellor, Jr. |
| 3,625,518 | A | 12/1971 | Solheim |
| 3,771,794 | A | 11/1973 | Crockett |
| 3,791,652 | A | 2/1974 | Schuler |
| 3,815,921 | A | 6/1974 | Turner |
| 4,139,196 | A | 2/1979 | Riley |
| 4,239,216 | A | 12/1980 | Bauer |
| 4,498,673 | A | 2/1985 | Swanson |
| 4,600,195 | A | 7/1986 | Hunter |
| 4,671,513 | A | 6/1987 | Swanson |
| 4,735,414 | A | 4/1988 | Williams et al. |
| 4,756,534 | A | 7/1988 | Thompson |
| 4,804,184 | A | 2/1989 | Maltby |
| 4,822,052 | A | 4/1989 | Dimmick et al. |
| 4,988,102 | A | 1/1991 | Reisner |
| 5,118,112 | A | 6/1992 | Bregman et al. |
| 5,213,329 | A | 5/1993 | Okumoto et al. |
| 5,326,105 | A | 7/1994 | Fenton, Jr. |
| 5,351,952 | A | 10/1994 | Hackman |
| 5,438,518 | A | 8/1995 | Bianco et al. |
| 5,441,256 | A | 8/1995 | Hackman |
| 5,573,469 | A | 11/1996 | Dekura |
| 5,632,695 | A | 5/1997 | Hlinka et al. |
| 5,682,230 | A | 10/1997 | Anfinsen et al. |
| 5,728,006 | A | 3/1998 | Teitell et al. |
| 5,766,088 | A | 6/1998 | Severtsen |
| 5,779,555 | A | 7/1998 | Nomura et al. |
| 5,779,565 | A | 7/1998 | Adams |
| 5,792,000 | A | 8/1998 | Weber et al. |
| 5,800,281 | A | 9/1998 | Gilbert |
| 5,826,874 | A | 10/1998 | Teitell et al. |
| 5,931,745 | A | 8/1999 | Adams |
| 5,941,779 | A | 8/1999 | Zeiner-Gundersen |
| 5,952,921 | A | 9/1999 | Donnelly |
| 5,984,798 | A | 11/1999 | Gilmour |
| 6,073,086 | A | 6/2000 | Marinelli |
| 6,083,123 | A | 7/2000 | Wood |
| 6,093,113 | A | 7/2000 | Mertens |
| 6,095,928 | A | 8/2000 | Goszyk |
| 6,224,493 | B1 | 5/2001 | Lee et al. |
| 6,251,028 | B1 | 6/2001 | Jackson |
| 6,302,461 | B1 | 10/2001 | Debras et al. |
| 6,366,205 | B1 | 4/2002 | Sutphen |
| 6,375,579 | B1 | 4/2002 | Hart |
| 6,413,167 | B1 | 7/2002 | Burke |
| 6,447,405 | B1 | 9/2002 | Chen |
| 6,449,803 | B1 | 9/2002 | McConchie |
| 6,471,601 | B1 | 10/2002 | McCabe et al. |
| 6,517,352 | B2 | 2/2003 | Smith |
| 6,527,648 | B2 | 3/2003 | Erickson et al. |
| 6,569,029 | B1 | 5/2003 | Hamburger |
| 6,585,605 | B2 | 7/2003 | Erickson et al. |
| 6,709,344 | B2 | 3/2004 | Erickson et al. |
| 6,719,648 | B1 | 4/2004 | Smith |
| 6,753,778 | B2 | 6/2004 | Kruger |
| 6,793,585 | B1 | 9/2004 | Miyamoto et al. |
| 6,821,211 | B2 | 11/2004 | Otten et al. |
| 6,860,818 | B2 | 3/2005 | Mahaffey |
| 7,101,287 | B1 | 9/2006 | Wagner |
| 7,104,900 | B1 | 9/2006 | Finley |
| 7,160,200 | B2 | 1/2007 | Grober |
| 7,228,670 | B2 | 6/2007 | Ollman |
| 7,250,006 | B2 | 7/2007 | McGonigle |
| 7,264,555 | B2 | 9/2007 | Lee et al. |
| 7,310,895 | B2 | 12/2007 | Whittlesey et al. |
| 7,311,612 | B2 | 12/2007 | DeLucia |
| 7,396,296 | B2 | 7/2008 | Evans |
| 7,406,386 | B2 | 7/2008 | Brett et al. |
| 7,476,160 | B2 | 1/2009 | Hocknell et al. |
| 7,537,526 | B2 | 5/2009 | Cho |
| 7,641,565 | B2 | 1/2010 | Kiraly |
| 7,648,426 | B2 | 1/2010 | Evans |
| 7,672,781 | B2 | 3/2010 | Churchill et al. |
| 7,699,717 | B2 | 4/2010 | Morris et al. |
| 7,704,155 | B2 | 4/2010 | Bennett et al. |
| 7,705,733 | B2 | 4/2010 | Tethrake et al. |
| 7,736,242 | B2 | 6/2010 | Stites et al. |
| 7,758,447 | B2 | 7/2010 | Sugimae |
| 7,780,541 | B2 | 8/2010 | Bauer |
| 7,803,065 | B2 | 9/2010 | Breier et al. |
| 7,804,404 | B1 | 9/2010 | Balardeta et al. |
| 7,837,574 | B2 | 11/2010 | Brunner |
| 7,837,575 | B2 | 11/2010 | Lee et al. |
| 7,837,577 | B2 | 11/2010 | Evans |
| 7,870,790 | B2 | 1/2011 | Sato et al. |
| 7,878,921 | B2 | 2/2011 | Bennett et al. |
| 7,909,705 | B2 | 3/2011 | Gill et al. |
| 7,927,236 | B2 | 4/2011 | Brunton et al. |
| 7,934,999 | B2 | 5/2011 | Cackett et al. |
| 7,946,926 | B1 | 5/2011 | Balardeta et al. |
| 7,967,695 | B2 | 6/2011 | Voges et al. |
| 8,012,034 | B1 | 9/2011 | Cackett et al. |
| 8,142,304 | B2 | 3/2012 | Reeves |
| 8,226,495 | B2 | 7/2012 | Savarese et al. |
| 8,226,501 | B2 | 7/2012 | Stites et al. |
| 8,253,586 | B1 | 8/2012 | Matak |
| 8,303,429 | B2 | 11/2012 | Cackett et al. |
| 8,371,962 | B2 | 2/2013 | Solheim et al. |
| 8,430,764 | B2 | 4/2013 | Bennett et al. |
| 8,496,543 | B2 | 7/2013 | Cackett et al. |
| 8,517,850 | B1 | 8/2013 | Beno et al. |
| 8,517,851 | B2 | 8/2013 | Cackett et al. |

(56) References Cited

U.S. PATENT DOCUMENTS 8,579,731 B2 11/2013 Gadiyar et al.
8,617,005 B2 12/2013 Moran et al.
8,624,738 B2 1/2014 Savarese et al.
8,715,096 B2 5/2014 Cherbini
8,766,088 B2 7/2014 Cheng et al.
8,804,404 B2 8/2014 Asami et al.
8,840,483 B1 9/2014 Steusloff et al.
8,870,673 B2 10/2014 Beno et al.
8,992,346 B1 3/2015 Raposo
9,005,047 B2 4/2015 Savarese et al.
9,195,781 B2 11/2015 Savarese et al.
9,227,118 B2 1/2016 Beno et al.
9,403,073 B2 * 8/2016 McDonnell ..... A63B 53/00
9,409,071 B1 * 8/2016 Beno ..... A63B 53/00
9,789,361 B2 * 10/2017 Beno ..... A63B 24/0062
2002/0077189 A1 6/2002 Tuer et al.
2002/0187860 A1 12/2002 Shoane
2003/0008731 A1 1/2003 Anderson et al.
2003/0104876 A1 6/2003 Sosin
2003/0144088 A1 7/2003 Shoane
2004/0087384 A1 5/2004 Sosin
2004/0219987 A1 11/2004 Scott et al.
2005/0272516 A1 12/2005 Gobush
2005/0288119 A1 12/2005 Wang et al.
2006/0094527 A1 5/2006 Evans
2006/0128489 A1 6/2006 Mooney et al.
2006/0166737 A1 7/2006 Bentley
2006/0199659 A1 9/2006 Caldwell
2006/0255918 A1 11/2006 Bernstein et al.
2006/0261938 A1 11/2006 Lai et al.
2007/0049397 A1 3/2007 Bieske
2007/0072696 A1 3/2007 Chen
2007/0149310 A1 6/2007 Bennett et al.
2007/0149315 A1 6/2007 Bennett et al.
2007/0159336 A1 7/2007 Tethrake et al.
2007/0191126 A1 8/2007 Mandracken
2007/0270214 A1 11/2007 Bentley
2007/0298895 A1 12/2007 Nusbaum et al.
2007/0298896 A1 12/2007 Nusbaum et al.
2008/0020861 A1 1/2008 Adams et al.
2008/0125239 A1 5/2008 Clausen et al.
2008/0148050 A1 6/2008 Sparrell
2008/0198022 A1 8/2008 Battles et al.
2008/0227564 A1 9/2008 Breier et al.
2008/0254909 A1 10/2008 Callinan et al.
2009/0017944 A1 1/2009 Savarese et al.
2009/0088275 A1 4/2009 Solheim et al.
2009/0111602 A1 4/2009 Savarese et al.
2009/0124410 A1 5/2009 Rife
2009/0131190 A1 5/2009 Kimber
2009/0143882 A1 6/2009 Young
2009/0197694 A1 8/2009 Soracco et al.
2009/0209358 A1 8/2009 Niegowski
2009/0215551 A1 8/2009 Liang et al.
2009/0233735 A1 9/2009 Savarese et al.
2009/0239673 A1 9/2009 Drimer
2009/0247312 A1 10/2009 Sato et al.
2009/0247316 A1 10/2009 De La Cruz et al.
2009/0264214 A1 10/2009 De La Cruz et al.
2009/0298605 A1 12/2009 Wiegers
2009/0326688 A1 12/2009 Thomas et al.
2010/0056297 A1 3/2010 Roach et al.
2010/0093457 A1 4/2010 Ahem et al.
2010/0093458 A1 4/2010 Davenport et al.
2010/0093463 A1 4/2010 Davenport et al.
2010/0105499 A1 4/2010 Roach et al.
2010/0113174 A1 5/2010 Ahem
2010/0144455 A1 6/2010 Ahem
2010/0144456 A1 6/2010 Ahem
2010/0154255 A1 6/2010 Robinson et al.
2010/0210377 A1 8/2010 Lock
2010/0222152 A1 9/2010 Jaekel et al.
2010/0261543 A1 10/2010 Breier et al.
2010/0292018 A1 11/2010 Cackett et al.
2010/0298065 A1 11/2010 Soracco et al.
2010/0304877 A1 12/2010 Iwahashi et al.
2010/0308105 A1 12/2010 Savarese et al.
2010/0323811 A1 12/2010 Mickelson et al.
2011/0028230 A1 2/2011 Balardeta et al.
2011/0039637 A1 2/2011 Cackett et al.
2011/0053702 A1 3/2011 Stites et al.
2011/0053703 A1 3/2011 Stites et al.
2011/0143854 A1 6/2011 Bennett et al.
2011/0151989 A1 6/2011 Golden et al.
2011/0152003 A1 6/2011 Hartwell et al.
2011/0190070 A1 8/2011 Morris et al.
2011/0207560 A1 8/2011 Wright et al.
2011/0257945 A1 10/2011 Sato
2011/0275455 A1 11/2011 Soracco
2011/0277313 A1 11/2011 Soracco et al.
2011/0304460 A1 12/2011 Keecheril et al.
2011/0305369 A1 12/2011 Bentley et al.
2011/0312436 A1 12/2011 Cackett et al.
2012/0035003 A1 2/2012 Moran et al.
2012/0050529 A1 3/2012 Bentley
2012/0052971 A1 3/2012 Bentley
2012/0052972 A1 3/2012 Bentley
2012/0052973 A1 3/2012 Bentley
2012/0116548 A1 5/2012 Goree et al.
2012/0120572 A1 5/2012 Bentley
2012/0120573 A1 5/2012 Bentley
2012/0122574 A1 5/2012 Fitzpatrick et al.
2012/0122603 A1 5/2012 Cackett et al.
2012/0139729 A1 6/2012 Savarese et al.
2012/0196692 A1 8/2012 Beck et al.
2012/0202610 A1 8/2012 Voges et al.
2012/0215474 A1 8/2012 Bentley et al.
2012/0238381 A1 9/2012 Denton et al.
2012/0249330 A1 10/2012 Savarese et al.
2012/0256731 A1 10/2012 Luciano, Jr. et al.
2012/0276851 A1 11/2012 Layne, IV et al.
2012/0277015 A1 11/2012 Boyd et al.
2012/0277018 A1 11/2012 Boyd et al.
2012/0295726 A1 11/2012 Cherbini
2012/0316843 A1 12/2012 Beno et al.
2012/0322569 A1 12/2012 Cottam
2012/0331058 A1 12/2012 Huston et al.
2013/0012334 A1 1/2013 Stites et al.
2013/0029783 A1 1/2013 Kimizuka et al.
2013/0063432 A1 3/2013 Kaps et al.
2013/0095941 A1 4/2013 Bentley et al.
2013/0144411 A1 6/2013 Savarese et al.
2013/0203517 A1 8/2013 Bolane et al.
2013/0225317 A1 8/2013 Clausen et al.
2014/0014953 A1 1/2014 Asami et al.
2016/0210549 A1 7/2016 Savarese et al.

OTHER PUBLICATIONS

Machine translation generated on Mar. 8, 2016, of JP 2003190334 A (16 pages).

* cited by examiner

GOLF CLUB GRIP WITH DEVICE HOUSING

CROSS-REFERENCE TO RELATED APPLICATIONS

This application is a continuation of U.S. patent application Ser. No. 15/088,550, filed Apr. 1, 2016, which application is a continuation of U.S. patent application Ser. No. 15/049,832, filed Feb. 22, 2016, which application is a continuation of U.S. patent application Ser. No. 14/957,126, filed Dec. 2, 2015, which application is a continuation of U.S. patent application Ser. No. 14/496,460, filed Sep. 25, 2014, now issued as U.S. Pat. No. 9,227,118, which application is a continuation of U.S. patent application Ser. No. 13/946,543, filed Jul. 19, 2013, now issued as U.S. Pat. No. 8,870,673, which application is a continuation of U.S. patent application Ser. No. 13/711,097 filed Dec. 11, 2012, now issued as U.S. Pat. No. 8,517,850, the contents of each of which are incorporated by reference.

FIELD OF THE INVENTION

The invention relates to golf clubs, more particularly to mechanisms for fastening accessories to clubs.

BACKGROUND

Golfers can improve their games by gathering information about how they are playing. For example, if a golfer can track how many shots they are taking on each hole based on which clubs they are using in different situations, the golfer would have a tool for choosing the optimum club for each shot. Similarly, if a golfer could track where the ball comes to rest after each of their shots, they could compare this information to any available standard or average and identify what type of shots they need the most practice on.

Digital or electronic technologies potentially have the promise to provide golfers with information that they can use to improve their game. However, attempts to add digital or electronic equipment to golf clubs are sometimes not successful. Sensors and other devices have a significant failure rate out on the golf course.

SUMMARY

The invention provides a golf club configured to house an electronic device within a recess within the grip, thereby protecting the device from shock and exposure that arises when a golf club is used. By positioning the electronic device within a recess that is dimensioned to accommodate it, the device is housed securely and protected from shock fronts, resonant vibrations, and environmental elements during play. The grip material itself offers vibration-dampening, dissipating shock energy from high-powered golf hits. The grip can be configured to protect the electronic device from other in-use impacts, such as dropping, placing the club in the bag, throwing the club, moisture, extreme temperature, or direct sunlight. Moreover, during installation or removal of a grip, the recess protects the electronic device from damage by, for example, tools or the exposed end of the shaft. The invention thus also provides a golf club with an electronic device in which the electronic device is made interchangeable by, for example, removing and replacing the grip. By including one or a number of electronic devices or recesses in a golf club grip, a golfer can be given a powerful information-gathering tool. For example, where the electronic device is an RFID tag, a golfer can also use an RFID tag reader to track what club the golfer is using and where and when and to load all of the shot-tracking data into an associated computer. By analyzing the shot tracking data, a golfer can identify areas of play that need improvement and can focus on those areas in their practice time. Thus, a golf club grip configured to house an electronic device provides a valuable game-improvement tool.

In certain aspects, the invention provides a golf club with a head, a shaft, and a grip. The grip includes a recess dimensioned to receive an electronic device and having an electronic device disposed therein. Preferably, the electronic device is an RFID tag disposed within the recess. The recess may also include a battery, solenoid, sensors (accelerometers, gyroscopes, magnetometers, switches, or other electric or mechanical device, or a combination thereof. One or more wire or other connector may extend from the recess to another part of the golf club. For example, a wire may extend from the RFID in the recess, into and through the shaft. A recess can have any suitable shape, such as a shallow depression in a surface, a slit or bore into a surface, a pocket or crater, or an enclosed interior volume space. Suitable styles of grip include monolithic grips (e.g., molded polymer), wrapped grips, underlistings covered by an outer grip, others, or a combination thereof. In an underlisting-style grip, one or more recess may be on an outer or inner surface of either the underlisting or the outer grip or a combination thereof. Where the recess is, for example, a shallow depression on a surface of the grip, it may generally have a rectangular shape and be curved co-axially with the shaft. In some embodiments, the recess is a slot extending through a surface of the grip and into a material of the grip. An electronic device may be in the slot.

In certain embodiments, the electronic device comprises an RFID tag. The RFID tag can have any suitable shape, housing, or appearance. For example, an RFID tag may be housed in a polymer case. In some embodiments, an RFID tag is provided in the form of a flexible sheet of material having a rectangular shape. The RFID tag may molded into a material of the grip. For example, where the grip comprises an underlisting and an outer grip, the RFID tag may be molded into the material of the underlisting or into the material of the outer grip.

Additional protection or functionality may be provided by a case or insert, within the recess, to house the electronic device. For example, an insert may be provided that includes a viscoelastic dampening material. A part of the golf club, such as the grip or the insert, may include a material that is non-Newtonian, elastic, pseudo-elastic, thixotropic, rheopectic, plastic, or super-elastic. Part of the grip or insert may include a dilatant material such as D3O or a thixotropic gel. Where the electronic device is housed within a case that is in the recess, the case can be hard plastic optionally further including an additional dampening material (e.g., TPU or foam rubber). A case may include more than an electronic device such as, for example, two RFID tags, or an RFID tag and a battery.

The RFID tag can be fixed in place using, for example, an adhesive. The tag or other electronic device could be adhered to the grip or to the shaft. The RFID tag may be exposed to an exterior of the club. An RFID tag may have any suitable shape and size. For example, an RFID tag can have a shape similar to a hockey puck, grain of rice, flat rectangle, sphere, or other. An RFID tag may have no dimension longer than 10 cm. For example, an RFID tag could be smaller than about 5 cm (e.g., less than about 3 cm or 2 cm) in all dimensions. In some embodiments, the RFID tag is substantially flat and less than about a millimeter thick.

An RFID tag may have a hole through it, as may allow better adhesion of grip adhesive or allow for ventilation or curing of adhesive at installation. In some embodiments, the recess is an accessible compartment. For example, a portion of the grip can be configured like flap that is openable to reveal the contents of the recess.

In certain embodiments, the recess is within the interior of a material of the grip and the RFID tag is surrounded in all directions by the material of the grip. For example, the material of the grip surrounding the RFID tag may form a continual, seam-free surface enclosing the recess and the RFID tag. In some embodiments, the RFID tag is wrapped around the golf shaft, for example, along with a band of material that forms the grip.

In related aspects, the invention provides a grip for a golf club. The grip includes a recess dimensioned to receive an electronic device such as an RFID tag so that the electronic device is disposed within the recess. The recess may also include space for a battery, solenoid, sensor, switch, accelerometer, or other electric or mechanical device, or a combination thereof. The grip may be formed to accommodate one or more wire or other connector that would extend from the recess to another part of the golf club. The recess can have any suitable shape, such as a shallow depression in a surface, a slit or bore into a surface, a pocket or crater, or an enclosed interior volume space. Suitable styles of grip include monolithic grips (e.g., molded polymer), wrapped grips, underlistings covered by an outer grip, others, or a combination thereof. In an underlisting-style grip, one or more recess may be on an outer or inner surface of either the underlisting or the outer grip or a combination thereof. Where the recess is, for example, a shallow depression on a surface of the grip, it may generally have a rectangular shape and be curved co-axially with the shaft. In some embodiments, the recess is a slot extending through a surface of the grip and into a material of the grip, e.g., dimensioned to receive and hold an electronic device therein.

In certain embodiments, the grip comprises an underlisting an outer grip, or both. The grip may optionally have an electronic device such as an RFID tag molded into the grip, for example, molded into the material of the underlisting or into the material of the outer grip.

Additional protection or functionality may be provided by a case or insert, within the recess, to house an electronic device. For example, the grip may include an insert within the recess. The insert may, in turn, have a recess. In this way, the insert may provide viscoelastic dampening to a device disposed within the insert recess. A part of the grip, or the insert, may include a material that is non-Newtonian, elastic, pseudo-elastic, thixotropic, rheopectic, plastic, or super-elastic. Part of the grip or insert may include D3O or a thixotropic gel. The insert may be a hard plastic case. A case may include space for more than one electronic device such as, for example, two RFID tags, or an RFID tag and a battery.

The recess in a grip may have any suitable shape and size. For example, a recess may be shaped like an extended lumen, a bowl or hollow, a shallow depression, a cylinder, or other. The recess may have no dimension longer than 10 cm. For example, a recess tag could be smaller than about 3 cm (e.g., less than 2 cm) in all dimensions. In some embodiments, the recess is substantially flat and less than about a millimeter thick. In some embodiments, the recess is an accessible compartment. For example, a portion of the grip can be configured like flap that is openable to reveal the contents of the recess.

In certain embodiments, the recess is within the interior of a material of the grip defining a void space that is surrounded in all directions by the material of the grip. The material of the grip surrounding the void space may form a continual, seam-free surface enclosing the recess or may have a slot extending to an exterior of the grip.

DETAILED DESCRIPTION

Figure 1:
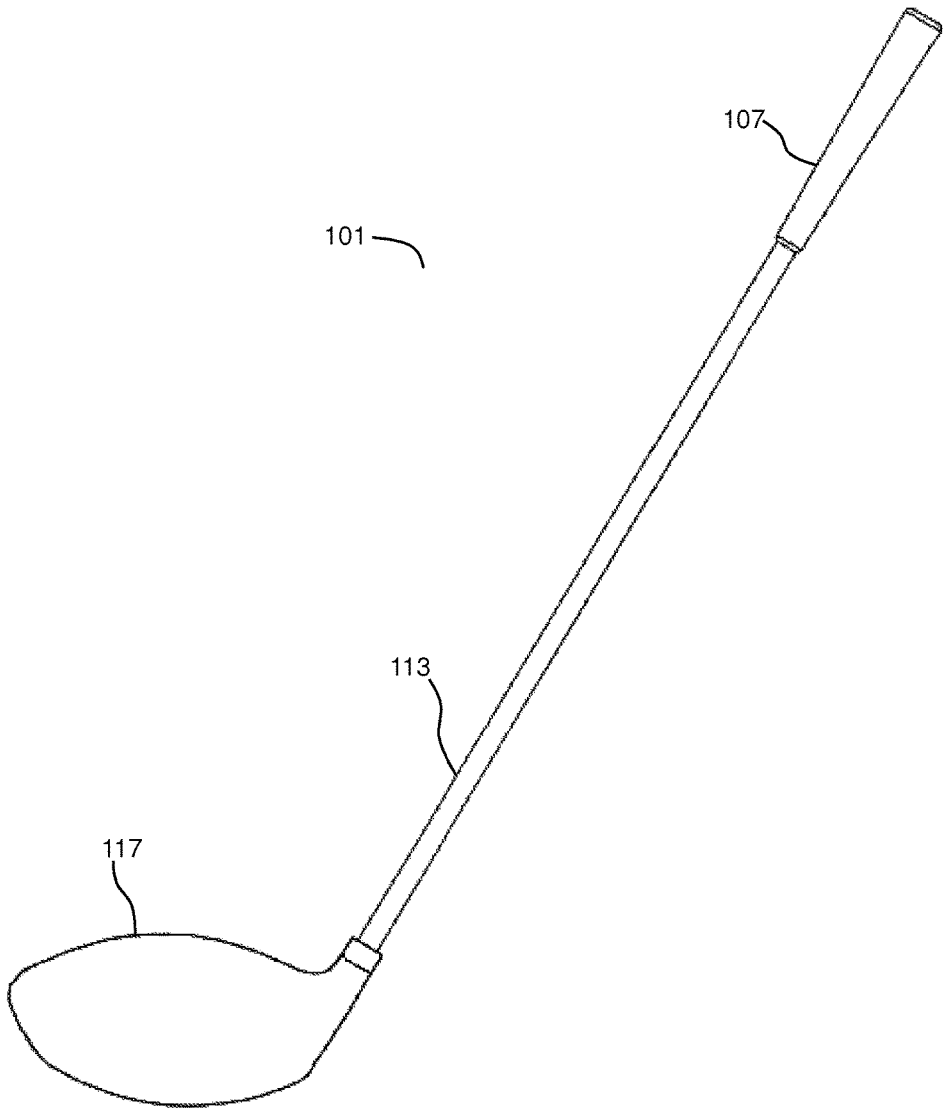
FIG. 1 shows a golf club with a grip according to embodiments of the invention.

FIG. 1 shows a golf club 101 having a shaft 113 extending from grip 107 to head 117. While depicted in FIG. 1 as a driver, any style of club is suitable for use with a grip 107 of the invention. Golf club 101 may be a driver, hybrid, wood, iron, wedge, or putter and may be described with a name such as a mashie or niblick. Grip 107 can be made from any suitable material and method.

Figure 2:
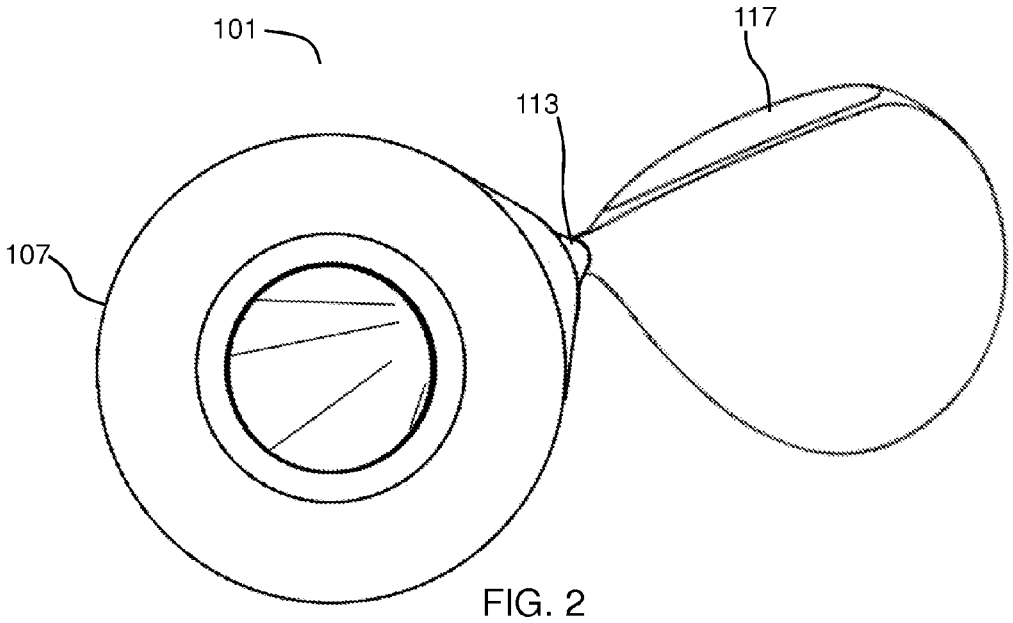
FIG. 2 gives a top-perspective view of the golf club shown in FIG. 1.

FIG. 2 gives a top-perspective view of the golf club 101, showing head 117 connected to shaft 113 extending to grip 107. Grip 107 may generally have an elongated shape, preferably slightly tapered on the outside. Grip 107 may be substantially cylindrical and tapered, or may have a pistol-grip, handlebar-grip, or blade-like shape. For example, where the invention provides a putter grip with a housing, the grip can be tubular, tapered, a paddle style (with a flat area for the thumbs), a pistol style (with a protruding area), or any other style known in the art. Grip 107 may be substantially evenly round or have a reminder (i.e., a line or rib on the grip that reminds the golfer where the hand should be placed).

Grip 107 may be described as having a sleeve member with a gripping surface. One end of the sleeve is open to fit over the shaft of a golf club. The other end may be open, formed into a cap, or have another structure. Generally, grip 107 will have an internal bore to complement shaft 113. The maximum length of the grip may generally be between about 20 cm and about 45 cm, e.g., between about 23 cm and about 31 cm. Generally, the grip may have a mass between about 5 grams and about 100 grams, e.g., between about 20 grams and about 70 grams. In some embodiments, grip 107 has a mass between about 45 grams and about 55 grams. For example, grip 107 may have a mass between about 40 grams and about 55 grams, or between about 15 grams and about 70 grams (e.g., between about 44 grams and about 53 grams). In certain embodiments, the mass is between about 48 grams and about 52 grams.

Grip 107 can be made with rubber, cotton, synthetic materials, leather, or a composite. It can be formed monolithically (i.e., all of one piece of one material) or as an assemblage. Grip 107 can formed by injection molding, compression molding, or co-molding. Natural rubber, synthetic rubber and compound materials can be used alone or in conjunction with a number of cord and surface configurations to offer a certain tactile, softness or gripping characteristics. A grip of the invention can be made with cord made of cotton, and grips can be half or full corded. Rubber grips can be made from a blend of liquid rubber and granulated cork, optionally pressure molded, sanded, or painted. Grips can be made of plastics or polymer materials such as, for example, Ethylene Propylene Diene Monomer (EPDM). Grips can be made to include materials such as cowhide, calfskin, kangaroo, snakeskin, or others. They can be spiral wrapped. Corded grips can be corded with strands of thread, e.g., to create a non-slip "rain grip". A recess or device can either be co-molded into the grip material, or inserted after the grip is made. Co-molding into the grip saves weight, allows for greater tolerance, and makes application more streamlined and results in a more attractive grip to some users. A grip or a component of a grip according to the invention can be injection molded, compression molded, or a combination thereof. Suitable materials or methods of making a grip are described in Golf Club Grip, U.S. Pub. 2007/0072696.

Grip 107 may include a graphic, emblem, or marked area. A mark, graphic, or emblem can include an area of a different thickness or texture (e.g., a bas-relief), a pigment, a sticker, a medallion, or other indicator (e.g., FIG. 10). Generally, such an indicator may be a corporate logo or other visible element, a reminder (e.g., tactile), or both. In some embodiments, a grip of the invention is designed to complement a club with a repositionable shaft. Exemplary club systems are described in U.S. Pat. No. 7,878,921; U.S. Pat. No. 7,476,160; U.S. Pub. 2011/0143854; U.S. Pub. 2010/0261543; and U.S. Pub. 2008/0254909, the contents of each of which are herein incorporated by reference in their entirety.

Figure 3:
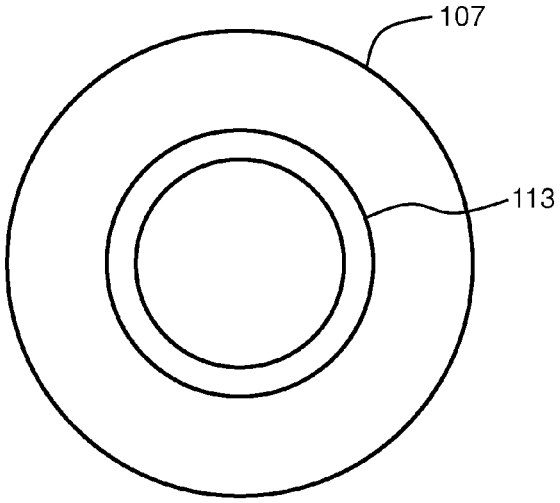
FIG. 3 shows a cross-sectional view of a golf club shaft and grip.

FIG. 3 shows a cross-sectional view of a golf club shaft and grip. It will be appreciated that the view presented in FIG. 3 can also be taken to represent an end-view of grip 107 mounted on shaft 113 with no butt cap. Moreover, as a cross-sectional view through the grip portion of club 101 as shown in FIG. 1, FIG. 3 may be taken at any position along grip 107. As shown in FIG. 3, grip 107 has a substantially circular cross-sectional shape. In some embodiments, a cross-sectional shape of grip 107 is oblong, oval, tear-drop or other, or circular but with a protruding reminder. In general, grip 107 will include a recess for housing an electronic device.

Figure 4:
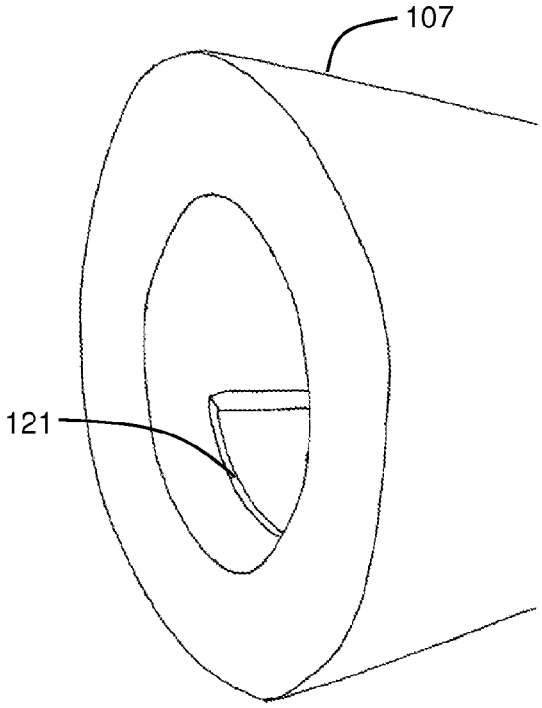
FIG. 4 presents a perspective view into a golf club grip.

FIG. 4 presents a perspective view into a golf club grip 107 showing a recess 121 therein. Recess 121 is shown here as a shallow depression on an inside surface of grip 107, generally having a rectangular perimeter. As shown in FIG. 4, recess 121 is configured to house a thin device that may optionally be flat, pliable, or curved and that fits within a rectangular area. One exemplary device is an RFID tag. One exemplary RFID tag is the general purpose RFID tag sold under the trademark SQUIGGLE by Alien Technology Corporation (Morgan Hill, Calif.). An RFID tag may be about 98.2 mm long×12.3 mm wide×0.3 mm thick and includes a UHF RFID integrated circuit, such as the one sold under the trademark HIGGS by Alien Technology Corporation, and a squiggle antenna design housed in a pliable poly-vinyl chloride sleeve with a rubber-based adhesive backing. Such an RFID tag may be disposed within recess 121 with grip 107 installed on shaft 113.

While shown in FIG. 4 as having an open, substantially featureless end, grip 107 may have any suitable end-form, such as a close end or butt cap or decorative finish or flange. In certain embodiments, grip 107 is provided with an integrated or separate cap, such as a butt cap, to cover or close an end of the grip. A butt cap can screw on (for example by molded threads in the cap and in the grip), be glued on, sewn on, snap on, press-fit and can be a separate piece or can be formed with the grip by a flap or strap of material. A butt cap can be styled to make the grip appear as a standard grip, or it can be fashioned to call attention to the functionality of the grip (e.g., with a logo or indicia showing that it is part of a grip with recess 121). As shown in FIG. 4, recess 121 allows an electronic device to be held and optionally concealed within the grip area of golf club 101.

Figure 5:
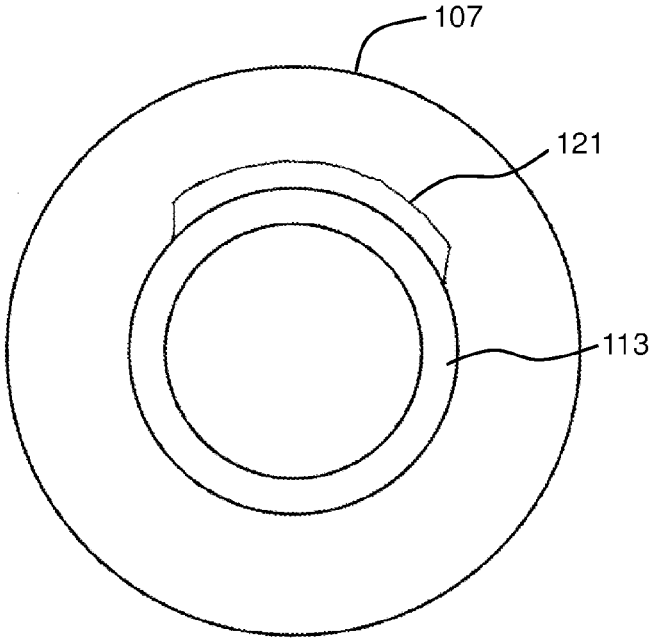
FIG. 5 shows a cross-sectional view of a golf club shaft and grip.

FIG. 5 shows a cross-sectional view of the grip of FIG. 4, installed onto golf club shaft 113. As shown in FIG. 5, recess 121 generally parallels a surface of shaft 113 or an outer surface of grip 107, although other forms are within the scope of the invention. Due to the pliable nature of an RFID tag, such a tag may be disposed within recess 121. The tag may be held in place solely by the enclosure of recess 121, or also through the use of an adhesive. The tag and recess 121 may have a thin, rectangular shape suited to the above-described RFID tags, or may have any other suitable shape. For example, recess 121 may be a deep rectangle (like a trench), an oblong shape, a fully enclosed volume such as a sphere, ovoid, or rectangle, a channel, an irregular shape, a slit, or other shape.

Figure 6:
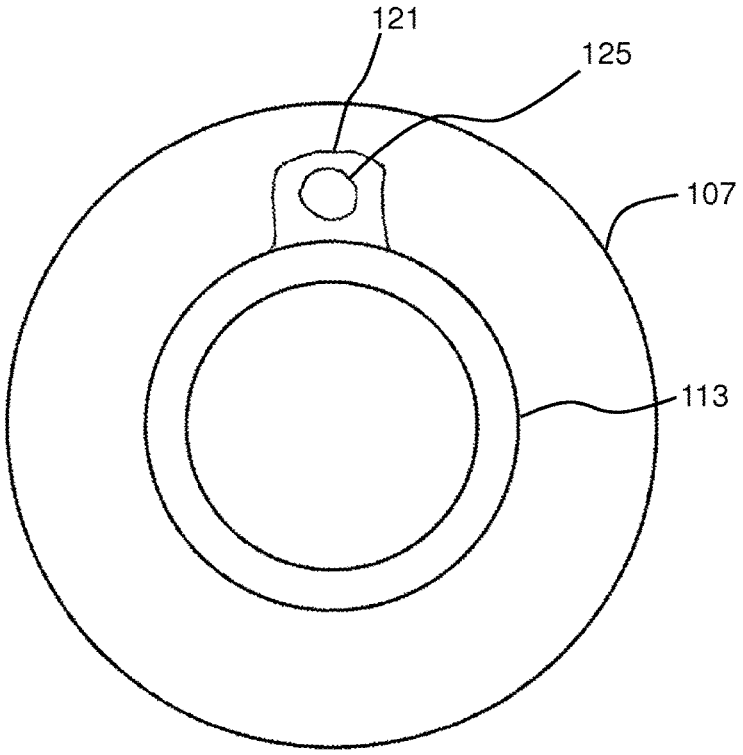
FIG. 6 shows a cross-sectional view of a golf club shaft and grip.

FIG. 6 shows a cross-sectional view of a golf club shaft 113 and grip 107 having a recess 121 with a deep rectangle shape, having a device 125 disposed therein. Device 125 may be any suitable device. For example, device 125 may be the implantable RFID microchip sold as the Unique Device Identifier (UDI) by VeriTeQ (Delray Beach, Fla.). The UDI is approximately the size of a grain of rice, and can encode a 16-digit character string. Device 125 may be seated in recess 121 snugly or loosely, or may be surrounded by a secondary material. That is, in some embodiments, grip 107 is made substantially of a first material, and has a recess 121 that is filled with a second material, such as a shock-absorbing foam or a viscoelastic dampening material. Embedded therein is device 125 (e.g., the UDI).

Figure 7:
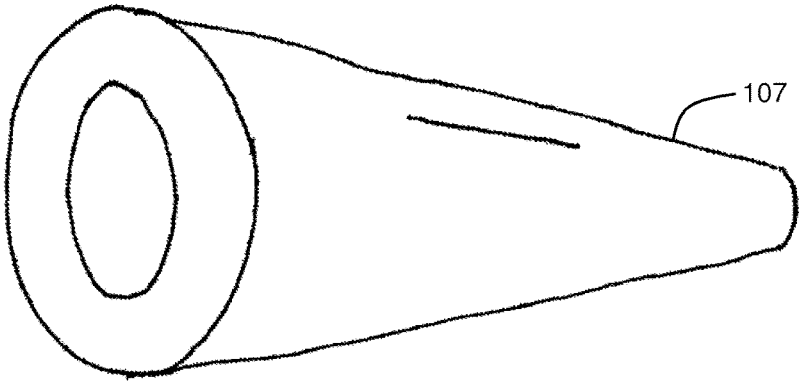
FIG. 7 is a perspective view of a golf club grip according to certain embodiments.

FIG. 7 shows another embodiment of a recess 121 in a grip 107. Here, recess 121 may be substantially slot-shaped. The slot may extend from an exterior surface of grip 107 into an interior.

Figure 8:
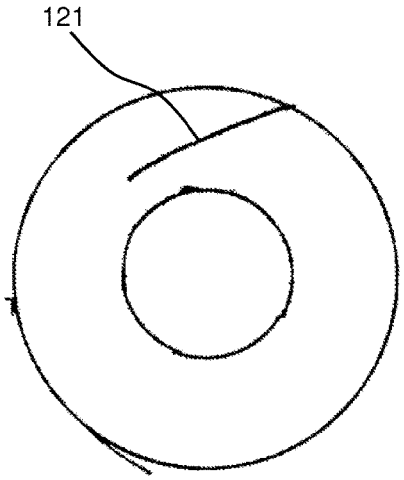
FIG. 8 is a cross-sectional view of the grip of FIG. 7.

FIG. 8 shows recess 121 as a slot in a cross-sectional view of grip 107 from FIG. 7.

Figure 9:
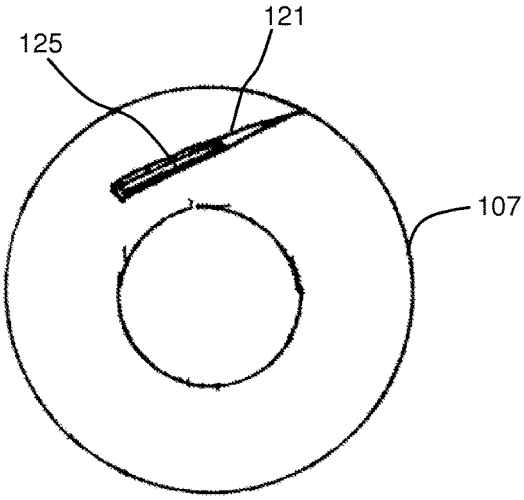
FIG. 9 is a cross-sectional view of the grip of FIG. 7 shown housing an electronic device.

FIG. 9 is shows a slot-shaped recess 121 in grip 107 having a device 125 inserted therein. Device 125 may be fastened into slot-shaped recess 121 by pressure (e.g., the ambient compressive force from the material of grip 107 exerted through the sides of slot-shaped recess 121); by an adhesive, or a combination thereof.

Figure 10:
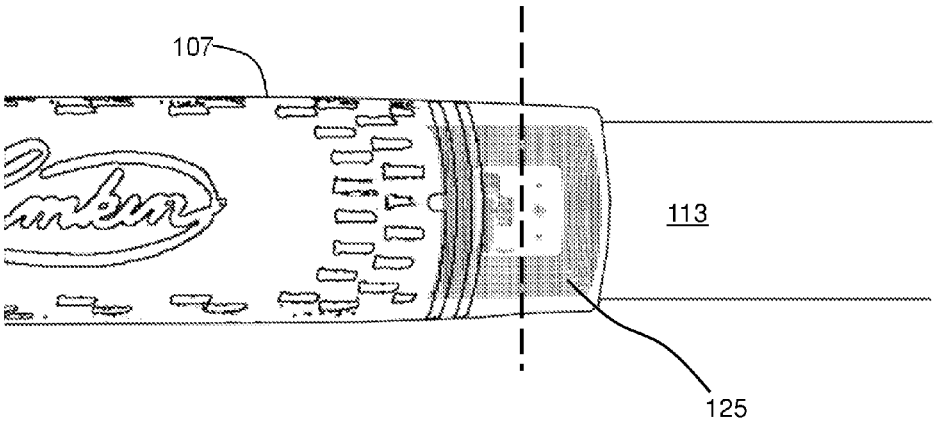
FIG. 10 shows a grip and shaft of some embodiments.

FIG. 10 shows a grip 107 and shaft 113 and shows where insert 125 may be located in recess 121 underneath grip 107. Device 125 may be, for example, an RFID tag such as the HF-I standard transponder having part number RI-I11-114B-01 and sold under the trademark TAG-IT by Texas Instruments (Dallas, Tex.). The HF-I standard transponder includes a resonance circuit and microchip on a PET foil. Aluminum is used for the antenna and to provide a capacitor that can tune the tag to a specific frequency. Frequency offset can compensate for detuning that may be associated with use with different materials, such as a paper or PVC sleeve or material of grip 107 or shaft 113. In certain embodiments, an RFID tag conforms to ISO standards that meet certain international radio regulations. Transmission from a tag reader to the tag can use amplitude shift keying with index between 10% and 30% or 100% and data coding, while tag to tag reader can use ASK or frequency shift keying. In some embodiments, the tag will respond in the mode of the reader.

Each RFID tag can have a 64-bit unique identifier. Collisions of a multiplicity of RFID tags may also be implemented to allow multiple tags to be used simultaneously. Also, the application family identifier (AFI) may be supported by an RFID tag such as the HF-I standard transponder. An RFID tag may be provided for device 125 having any suitable dimensions. For example, device 125 may be about 15 mm×15 mm×0.3 mm. While depicted as having roughly certain dimensions, device 125 may have other dimensions. For example, device 125 may be about 45 mm×45 mm×0.3 mm (and, if wrapped around shaft 113 with an edge parallel to an axis of shaft 113, device 125 may extend around 80-90% of a circumference of shaft 113). In some embodiments, an edge of device may be between about 10 mm and about 20 mm, e.g., between about 15 mm and about 18 mm.

Figure 11:
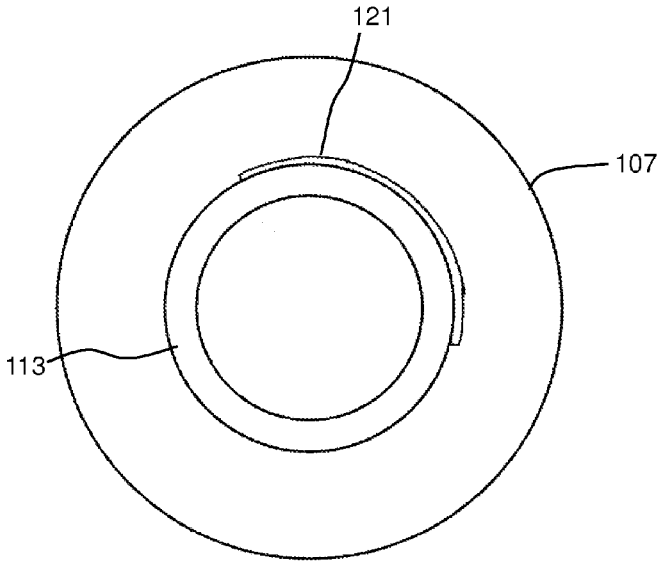
FIG. 11 reveals a cross section of the grip and shaft of FIG. 10.

FIG. 11 gives a cross section of grip 107 and shaft 113 along the dotted line shown in FIG. 10. Here, recess 121 is shown as being thin, or shallow. Recess 121 may have dimensions of about 18 mm×18 mm×0.5 mm (e.g., 17.6 mm×17.6 mm×0.3 mm). In certain embodiments, recess 121 is made to have a depth between about 0.15 mm and about 0.25 mm. For example, where device 125 has a thickness of about 0.3 mm, if recess 121 has a slightly shallower depth, then a material of grip 107 will press against device 125 and even exhibit increased pressure due to local pliable deformation of the material to accommodate device 125.

Even with device 125 in contact with shaft 113, a material of grip 107 may provide vibration dampening necessary for protection of device 125. For example, when club 101 is used to strike a ball, shock waves of energy (compression, motion, heat, sound, etc.) may propagate through club 101. Upon arrival at device 125, recess 121, and grip 107, a material of grip 107 may provide a deadening effect. Energy from the shock waves may dissipate in myriad elastic and resonant deformations of material within grip 107 while also being transferred to a golfer.

In some embodiments, a dimension of recess 121 is between about 50% and about 99% of a dimension of device 125, for example, between about 75% and about 95% (e.g., between about 85% and about 90%). Any dimension of recess 121 can be provided slightly smaller than a corresponding dimension of device 125 such as, for example, length, width, diameter, depth, or an irregular dimension. While discussed with reference to FIG. 11 as being relatively thin and flat, an object (device 125 or other insert) can have more substantial forms.

Figure 12:
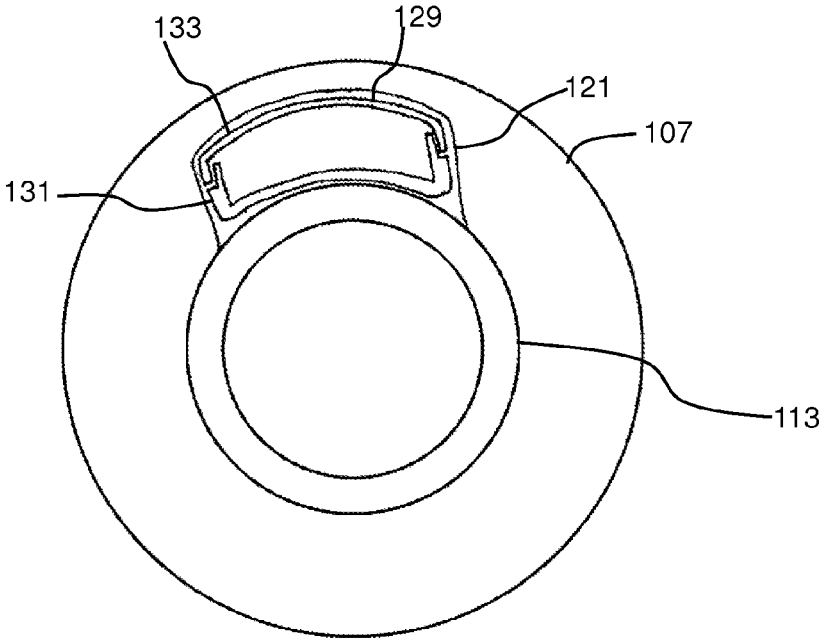
FIG. 12 shows a cross section of a grip and shaft housing a device of the invention.

FIG. 12 shows a cross section of grip 127 and shaft 113 in which an insert 129 is positioned in recess 121. Insert 129 may be provided in the form of a case or box, for example, a small plastic box. Here, insert 129 has a base portion 131 fit with lid portion 133. Insert 129 as a case or box may be dimensioned to accommodate a device 125 (not pictured) as well as optionally other elements such as a battery or other tool. In certain embodiments, insert 113 has a hole in it. In certain embodiments, shaft 113 has a hole through it. In certain embodiments, a wire extends through a hole in insert 129 and shaft 113 connecting a device 125 within insert 129 to some other element in club 101. In some embodiments, insert 129 further contains an additional dampening material (e.g., a foam or polymer) and device 125 may be dimensioned like a grain of rice, e.g., the RFID microchip sold as the Unique Device Identifier (UDI) by VeriTeQ (Delray Beach, Fla.).

Figure 13:
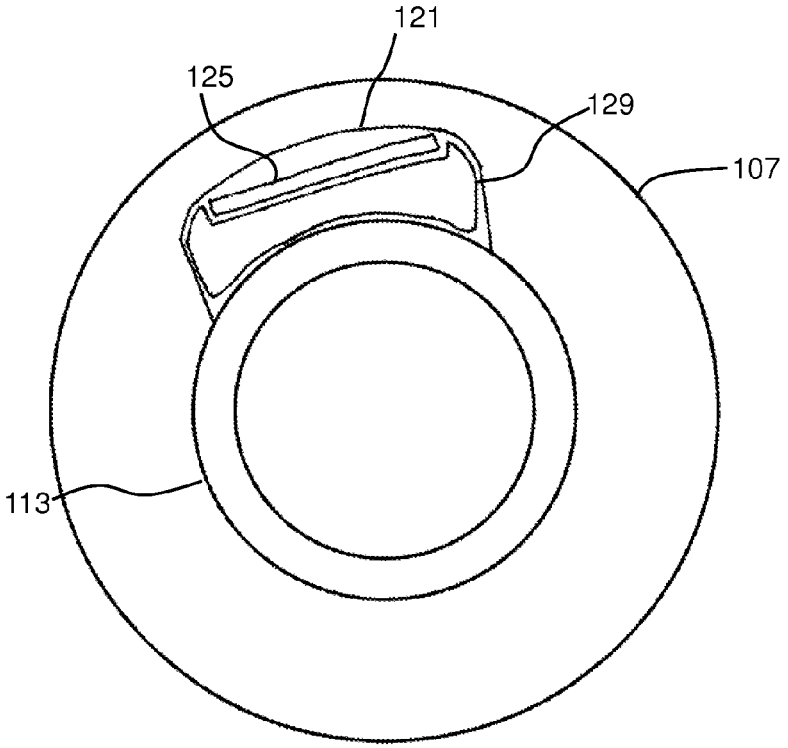
FIG. 13 shows a cross section of a grip and shaft housing a device of the invention.

FIG. 13 shows another embodiment of insert 129. Here, insert 129 may be provided in the illustrated form to provide substantial protection and vibration dampening to device 125. It is reported that some prior art attempts to locate electronic devices in the grip region of a golf club meet with failure apparently due to shock waves whereby discontinuities in pressure or energy propagate rapidly through a club in connection with use of the club. Insert 129 may provide a viscoelastic dampening material, such as thermoplastic polyurethane, a springy foam, D3O, or a thixotropic material to mitigate stresses associated with use of the club. In certain embodiments, material of insert 129 (e.g., a dampening material) works in conjunction with an elastic material (e.g., rubber) of grip 107 to provide sufficient shock mitigation. For example, in some embodiments, the grip includes a dilatant material such as D3O. A dilatant material (e.g., D3O) is sometimes called a shear thickening material and is one in which viscosity increases with a rate of shear strain. D3O is known in the art and is used in football protective pads. Where, for example, a device 125 would benefit from heightened vibration dampening, combining the dampening of insert 129 with the elasticity of grip 107 may provide protection so that electronic devices may operate.

Figure 14:
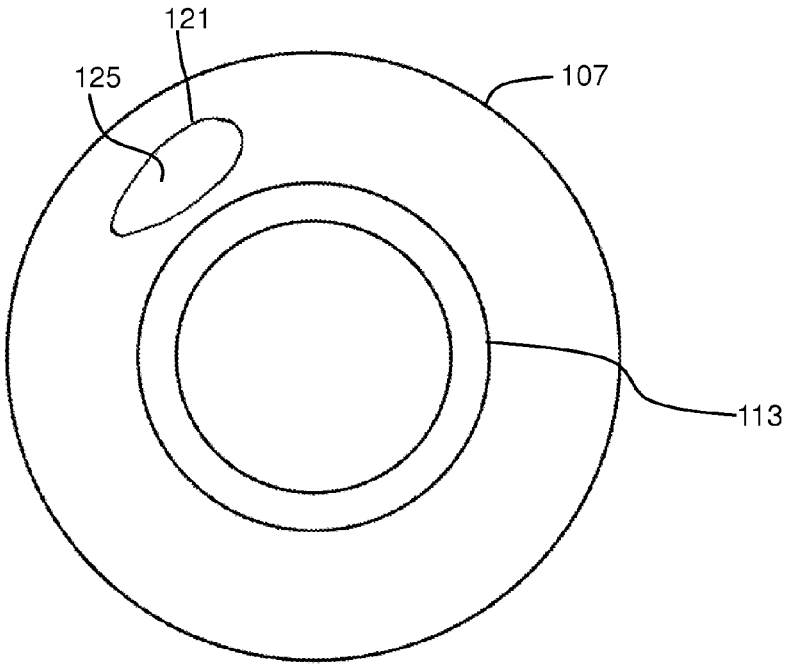
FIG. 14 shows a cross section of a grip and shaft housing a device of the invention.

FIG. 14 shows grip 107 having recess 121 optionally filed with a device 125. Here, device 125 may be dimensioned like a grain of rice, e.g., the RFID microchip sold as the Unique Device Identifier (UDI) by VeriTeQ (Delray Beach, Fla.). While shown here as having a teardrop-shaped outline, this may be attributable to viewing angle. For example, a major axis of an oblong device 125 may be oblique and neither perpendicular nor parallel to an axis of shaft 113. In such a case, if the view is down an axis of 113, an outline of device 125 or recess 121 may appear teardrop-shaped due to foreshortening. In other related embodiments, recess 121 or device 125 has a major axis that is either perpendicular to or parallel to an axis of shaft 113. One unexpected benefit of the embodiment depicted in FIG. 14 is that an electronic device 125 such as an RFID tag or microchip may be provided for golf club 101 with no part of device 125 making direct contact with an inelastic or non-dampening material (e.g., shaft 113 or head 117) of club 101. For example, even if device 125 is housed in a plastic or inelastic shell, that shell may be surrounded continually in all directions by an elastic or dampening material of grip 107. Accordingly, the invention provides a golf club 101 having device 125 in grip 107 that is not in direct contact with shaft 113 or other inelastic portion of the club. The device is surrounded on all sides, and in all directions, by the pliable or elastic material of grip 107. This device 125 may be an RFID tag such as, for example, the Unique Device Identifier (UDI) by VeriTeQ (Delray Beach, Fla.). This device 125 may be covered in all directions by material of grip 107 and thus not exposed to environmental elements such as direct sunlight, moisture, extremes of temperature. A device can be fully surrounded material of grip 107 by molding it into grip 107 when grip 107 is first molded, or grip 107 can be molded as two parts (e.g., halves) that are then cemented together. Fully surrounding device 125 can protect it from loss as well as ensuring that any one of device 125 stays uniquely associated with any one club 101 so that information gathering methods that use 125 may operate reliably. While depicted in FIG. 14 as fully enclosed by continual material of grip 107, a device 125 may be fully enclosed by a material of grip 107 that is continual but for an access aperture. An access aperture may be provided in the form of a slit, such as the slits depicted in FIGS. 7-9. A device 125 may be inserted into recess 121 in grip 107 as depicted in FIG. 14 through a slit that is provided from an exterior surface of grip 107, an interior surface of grip 107, or an end surface of grip 107. A slit may be substantially closed after insertion by compressive force of material of grip 107, by an adhesive, or a combination thereof.

In certain aspects, the invention provides or includes methods and systems for improving a golfer's game or increasing the enjoyment of golf that make use of information gathering. Information gathering systems and methods may make use of a mobile computing device, a computer-based system, or a combination thereof. Typical mobile computing devices include a smart phone such as the iPhone or Samsung Galaxy SII or a tablet such as the iPad or Samsung Galaxy Tab. A computer based system may be server computer, such as the rack-mounted server sold under the trademark BLADE by Hitachi America, Ltd. (Tarrytown, N.Y.) or a general purpose desktop or laptop computer (e.g., laptop sold under the trademark PORTEGE by Toshiba America Information Systems, Inc. (Irvine, Calif.). Generally, a mobile computing device or a computer-based system will include a tangible, non-transitory memory coupled to a processor via a bus, as well as mechanisms for input and output (e.g., screen, touchscreen, Wi-Fi card, network interface card, Ethernet port, USB port, keyboard, pointing device, other, or combination thereof). Information gathering may employ an RFID tag reader such as the RI-CTL-MB68 control module with USB and RS422/485 interface from Texas Instruments (Dallas, Tex.) or the Socket CompactFlash 6E RFID reader card from Dell Inc. (Round Rock, Tex.). Such a reader may be plugged directly into a variety of mobile computing devices. In this way, data from an RFID tag can be detected by an RFID tag reader and relayed to a mobile computing device, from which it may optionally be transferred to a computer system. This allows use of a specific club to be detected or monitored with the relevant information being gathered and stored in a file in the memory of the mobile computing device, computer system, or both. Communicating sports-related information is discussed in SYSTEMS AND METHODS FOR COMMUNICATING SPORTS-RELATED INFORMATION, U.S. patent application Ser. No. 13/156,116 to Tim Beno, et al., filed Jun. 8, 2011, the contents of which are hereby incorporated by reference in their entirety. Golf information gathering is discussed in U.S. Pat. No. 6,366,205; U.S. Pub. 2012/0277018; U.S. Pub. 2012/0249330; U.S. Pub. 2012/0139729; 2012/0035003; U.S. Pub. 2011/0304460; U.S. Pub. 2010/0308105; U.S. Pub. 2010/00113174; U.S. Pub. 2009/0017944; U.S. Pub. 2006/0261938; U.S. Pub. 2006/0255918; and U.S. Pub. 2005/0272516, the contents of each of which are incorporated by reference herein in their entireties. The relevant information can include data representing what club or clubs are used, when they are used, shots made, shot-tracking, scores, extrinsic data such as a average scores or score of pro golfers for comparison, other data, or a combination thereof.

Figure 15:
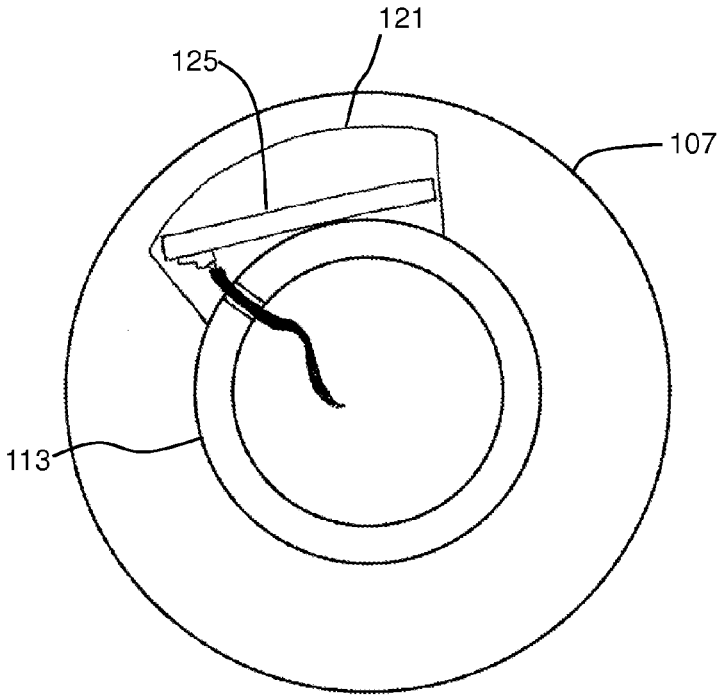
FIG. 15 shows a cross section of a grip and shaft housing a device of the invention.

FIG. 15 shows a grip 107 with recess 121 housing device 125. Here, a wire extends from device 125 into shaft 113. One or more such wire may extend through a hole in shaft 113, around an end of shaft 113, or an electrical conductor and inside/outside contact points may be formed in shaft 113. By such means, device 125 may include, or may be connected to other devices which may include, a battery, accelerometer, light or moisture detector, memory, processor, piezoelectric material, integrated circuit, other antenna or chip, RFID tag, LED, switch, others, or a combination thereof.

In some embodiments, which may be represented by FIGS. 2-15, grip 107 is substantially monolithic—e.g., mostly formed primarily of a single material (may have caps, trim, adhesive, surface finish or a combination thereof). In certain embodiments, grip 107 is structured to include an underlisting and an outer grip.

Figure 16:
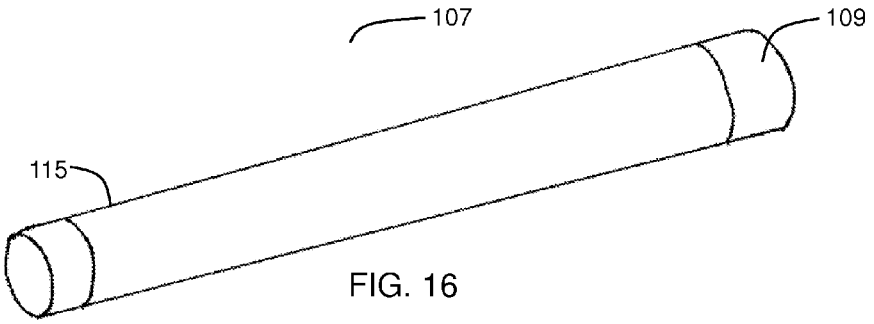
FIG. 16 is a side view of a grip with underlisting.

FIG. 16 shows a grip 107 with underlisting 109 surrounded by outer grip 115. With such an arrangement, an insert 121 may be provided in underlisting 109, outer grip 115, or a combination thereof.

Figure 17:
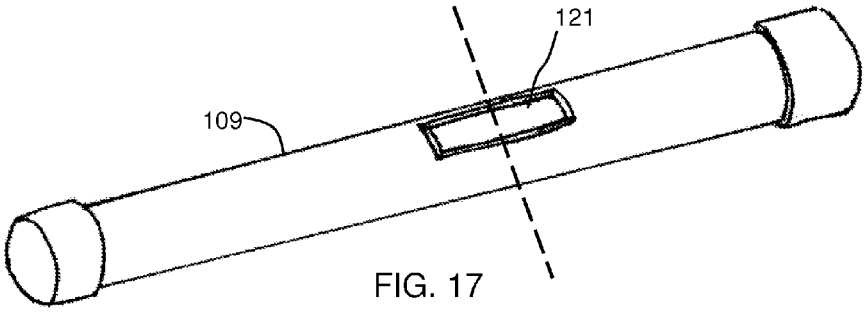
FIG. 17 shows the underlisting of the grip of FIG. 16.

FIG. 17 shows insert 121 in underlisting 109 of the grip 107 shown in FIG. 16. Recess 121 may have any suitable dimensions. For example, recess 121 may be a shallow rectangular cutout, and may be about 10 cm long×about 1.3 cm wide×about 0.3-0.5 mm deep. In some embodiments, recess 121 is about 4.5 cm×about 4.5 cm×about 0.3-0.5 mm deep. Recess 121 may be an oblong channel having dimensions similar to a grain of rice, or recess 121 may be hollow, cavity, bowl-shaped depression, crater-shaped, rectangular shaped, or have an irregular shape.

Figure 18:
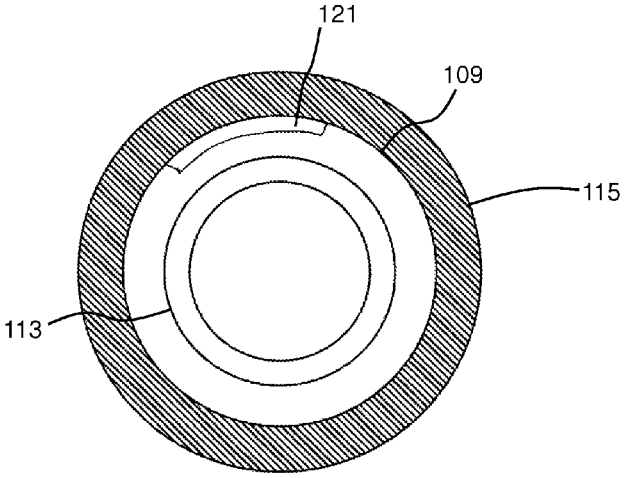
FIG. 18 is a cross section through the dotted line of FIG. 17.

FIG. 18 is a cross section of grip 107 as shown in FIG. 16 (along the area indicated by the dotted line in FIG. 17) with a shaft 113 inserted therethrough. Use of a grip 107 with underlisting 109 provides functional and manufacturing benefits in terms of an easy to form recess 121 (e.g., can be relatively inexpensive to mold or rout) due to being open on a surface that still results in an electronic device 125 being included in golf club 101 with no part of device 125 making direct contact with an inelastic or non-dampening material (e.g., shaft 113 or head 117) of club 101. A device 125 may be surrounded continually in all directions by an elastic or dampening material of underlisting 109 and outer grip 115. Accordingly, the invention provides a golf club 101 having device 125 in grip 107 that is not in direct contact with shaft 113 or other inelastic portion of the club. The device is surrounded on all sides, and in all directions, by the pliable or elastic material of grip 107 and thus not exposed to environmental elements such as direct sunlight, moisture, extremes of temperature. This can protect device 125 from loss as well as ensure that any one of device 125 stays uniquely associated with any one club 101 so that information gathering methods that use 125 may operate reliably. Use of an underlisted grip 107 allows recess 121 to be positioned in other locations, as well.

Figure 19:
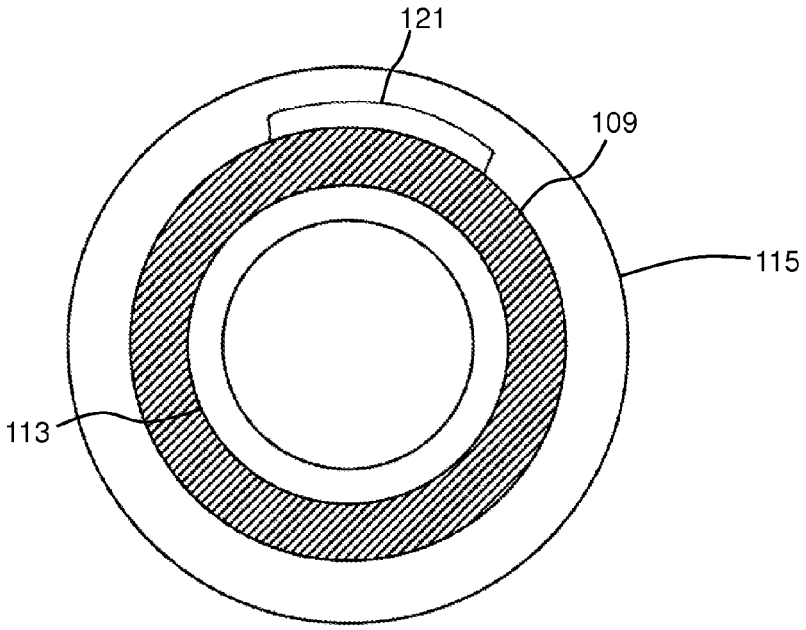
FIG. 19 is a cross section through a grip with underlisting.

FIG. 19 is a cross section through a grip 107 with underlisting 109 showing recess 121 along an inner surface of outer grip 115. This structure may provide the benefit of maximal vibration dampening to device 125, by allowing a full thickness of underlisting 109 to everywhere separate device 125 from shaft 113. It is noted that embodiments such as those depicted in FIGS. 19, 18, 17, 14, 13, 12, 8, 9, and 6 provide a golf club 101 in which a device 125 such as an RFID tag can be included that is everywhere spaced away from a shaft 113 (and club head 117) of the club. Due to the insight that shock waves from impact may propagate through inelastic portions of club 101 (e.g., shaft 113 and head 117), benefit is had by mitigating the interference of shock waves with device 125, allowing more delicate devices to be included.

In some embodiments, an underlisted grip 107 allows a club to include an interchangeable outer grip 115 in which a device 125 or recess 121 is concealed from a user and device 125 is made to be retained in recess 121 even when outer grip 115 is removed.

Figure 20:
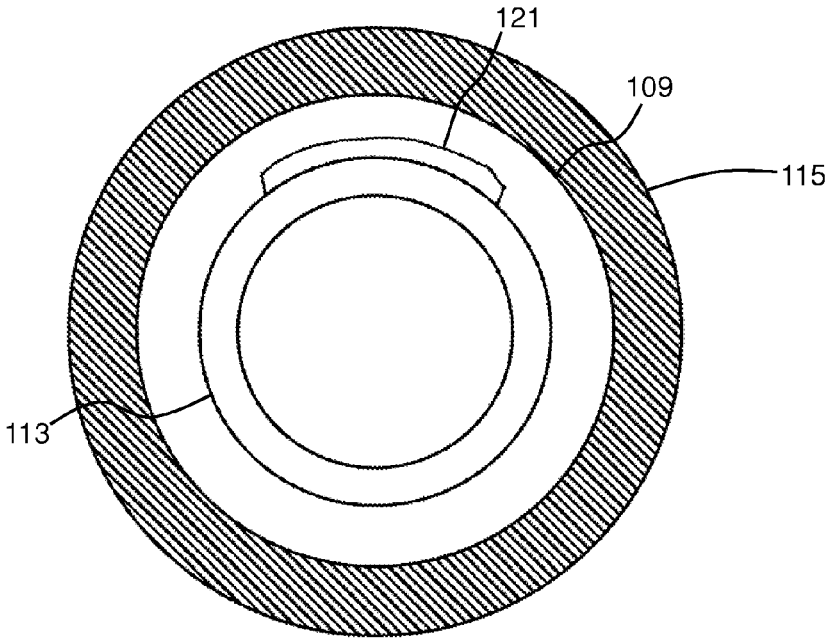
FIG. 20 is a cross section through a grip with underlisting.

FIG. 20 shows a recess 121 in an inner surface of underlisting 109. Outer grip 115 could be removed and recess 121 would not be exposed, thus retaining, protecting, or concealing, for example, device 125.

INCORPORATION BY REFERENCE

References and citations to other documents, such as patents, patent applications, patent publications, journals, books, papers, web contents, have been made throughout this disclosure. All such documents are hereby incorporated herein by reference in their entirety for all purposes.

EQUIVALENTS

Various modifications of the invention and many further embodiments thereof, in addition to those shown and described herein, will become apparent to those skilled in the art from the full contents of this document, including references to the scientific and patent literature cited herein. The subject matter herein contains important information, exemplification and guidance that can be adapted to the practice of this invention in its various embodiments and equivalents thereof.

What is claimed is:

1. A grip for a golf club, the grip comprising:

a sleeve member with a gripping surface, the sleeve member having a first end and a second end, the first end being open to fit over a shaft of the golf club;

an internal bore sized to complement the shaft of the golf club;

a recess within the grip;

an electronic device housed within the recess; and a secondary material within the recess.

2. The grip of claim 1, wherein the electronic device is seated in the recess surrounded by the secondary material.

3. The grip of claim 2, wherein the secondary material is a vibration dampening material.

4. The grip of claim 3, wherein the electronic device comprises a microchip and an antenna.

5. The grip of claim 1, wherein the electronic device does not come in direct contact with the shaft once the grip is attached to the shaft.

6. The grip of claim 1, wherein the electronic device is held in place within the recess by adhesive.

7. The grip of claim 1, wherein the secondary material comprises a shock-absorbing foam.

8. The grip of claim 1, wherein the secondary material surrounds at least a portion of the electronic device.

9. The grip of claim 1, wherein the secondary material is selected from the group consisting of non-Newtonian, viscoelastic, elastic, pseudo-elastic, thixotropic, rheopectic, plastic, super-elastic, or combinations thereof.

10. The grip of claim 9, wherein the secondary material comprises a viscoelastic dampening material.

11. The grip of claim 1, further comprising a second electronic device.

12. The grip of claim 1, wherein the electronic device is selected from the group consisting of a battery, accelerometer, light or moisture detector, memory, processor, piezoelectric material, integrated circuit, other antenna or chip, RFID tag, LED, switch, or combinations thereof.

13. The grip of claim 11, wherein the second electronic device is selected from the group consisting of a battery, accelerometer, light or moisture detector, memory, processor, piezoelectric material, integrated circuit, other antenna or chip, RFID tag, LED, switch, or combinations thereof.

14. The grip of claim 8, wherein the electronic device is surrounded continually in all directions by the secondary material.

15. The grip of claim 1, wherein the electronic device is positioned at the second end.

* * * * *